US005860556A

United States Patent [19]

Robbins, III

[11] Patent Number: 5,860,556

[45] **Date of Patent: *Jan. 19, 1999**

[54] COLLAPSIBLE STORAGE CONTAINER

[76] Inventor: Edward S. Robbins, III, 2802 E. Avalon Ave., Muscle Shoals, Ala. 35661

[ * ] Notice: The term of this patent shall not extend beyond the expiration date of Pat. No. 5,632,406.

[21] Appl. No.: 954,157

[22] Filed: Oct. 20, 1997

Related U.S. Application Data

[63] Continuation of Ser. No. 630,509, Apr. 10, 1996, abandoned.

[51] Int. Cl.[6] ..... B65D 1/44; B65D 8/12; B65D 8/14

[52] U.S. Cl. ..... 220/666; 220/608; 220/672; 220/675

[58] Field of Search ..... 220/666, 667, 220/669, 672, 675, 907, 8, 720, 721, 723, 673, 608; 215/11.3, 382, 900

[56] References Cited

U.S. PATENT DOCUMENTS

| | | | |
|---|---|---|---|
| 625,719 | 5/1899 | Crofford . | |
| 640,418 | 1/1900 | Royer . | |
| 1,040,652 | 10/1912 | Douglas . | |
| 1,048,935 | 12/1912 | Brady . | |
| 2,784,882 | 3/1957 | Du Bois . | |
| 2,880,902 | 4/1959 | Owsen . | |
| 2,893,167 | 7/1959 | Davidson . | |
| 2,899,110 | 8/1959 | Parker . | |
| 2,952,379 | 9/1960 | Potter . | |
| 2,985,915 | 5/1961 | Winstead . | |
| 3,143,429 | 8/1964 | Swanson et al. . | |
| 3,156,383 | 11/1964 | Melli . | |
| 3,220,544 | 11/1965 | Lovell | 220/8 X |
| 3,270,905 | 9/1966 | Kroekel | 220/666 X |
| 3,286,872 | 11/1966 | Burdick, Jr. . | |
| 3,301,293 | 1/1967 | Santelli . | |
| 3,326,421 | 6/1967 | Peace . | |
| 3,329,298 | 7/1967 | Demas . | |
| 3,394,018 | 7/1968 | Velonis et al. . | |
| 3,467,283 | 9/1969 | Kinnavy . | |
| 3,494,509 | 2/1970 | McGuire . | |
| 3,578,415 | 5/1971 | Hiltz . | |
| 3,608,268 | 9/1971 | Lauritzen . | |
| 3,707,241 | 12/1972 | Taylor . | |
| 3,804,663 | 4/1974 | Clark . | |
| 3,864,771 | 2/1975 | Bauer et al. . | |
| 3,875,941 | 4/1975 | Adair . | |
| 3,939,888 | 2/1976 | Scarnato . | |
| 4,087,024 | 5/1978 | Martin et al. . | |
| 4,428,507 | 1/1984 | Sneider . | |
| 4,456,134 | 6/1984 | Cooper . | |
| 4,492,313 | 1/1985 | Touzani . | |
| 4,595,037 | 6/1986 | LeBreton et al. | 220/723 X |
| 4,657,141 | 4/1987 | Sorensen | 220/675 X |
| 4,706,829 | 11/1987 | Li . | |
| 4,712,699 | 12/1987 | Lutz . | |
| 4,734,288 | 3/1988 | Engstrom et al. . | |
| 4,775,564 | 10/1988 | Shriver et al. . | |

(List continued on next page.)

FOREIGN PATENT DOCUMENTS

| | | | |
|---|---|---|---|
| 587.701 | 8/1924 | France . | |
| 002701454 | 8/1994 | France | 220/667 |
| 1 301 970 | 8/1969 | Germany . | |
| 2 340 967 | 3/1974 | Germany . | |
| 3937-456-A | 5/1991 | Germany . | |
| 4-102544 A | 4/1992 | Japan . | |
| 2 109 247 A | 6/1983 | United Kingdom . | |
| 2 138 525 A | 10/1984 | United Kingdom . | |
| WO 88/05014 | 7/1988 | WIPO . | |

*Primary Examiner*—Stephen J. Castellano
*Assistant Examiner*—Niki M. Eloshway
*Attorney, Agent, or Firm*—Nixon & Vanderhye P.C.

[57] ABSTRACT

A single fold collapsible container includes a peripheral side wall extending upwardly from a bottom wall, and terminating at an upper open end. The side wall has upper and lower portions separated by a peripheral fold line having a sideways S-shaped geometry such that the upper and lower portions are movable relative to one another between extended and collapsed positions. The one portion which is reverse foldable into the other portion has a thickness significantly less than the other portion.

15 Claims, 2 Drawing Sheets

U.S. PATENT DOCUMENTS

| | | | |
|---|---|---|---|
| 4,805,799 | 2/1989 | Robbins, III . | |
| 4,815,615 | 3/1989 | Phlaphongphanich . | |
| 4,836,409 | 6/1989 | Lane | 220/723 X |
| 4,836,970 | 6/1989 | Robbins, III . | |
| 4,842,165 | 6/1989 | Van Coney . | |
| 4,844,273 | 7/1989 | Hawkins . | |
| 4,846,376 | 7/1989 | Palmer . | |
| 4,865,211 | 9/1989 | Hollingsworth . | |
| 4,875,576 | 10/1989 | Torgrimson et al. . | |
| 4,892,126 | 1/1990 | Bucheler et al. . | |
| 4,925,055 | 5/1990 | Robbins, III et al. . | |
| 4,927,690 | 5/1990 | Welsh . | |
| 4,930,644 | 6/1990 | Robbins, III . | |
| 4,955,493 | 9/1990 | Touzani . | |
| 4,979,628 | 12/1990 | Robbins, III . | |
| 5,002,193 | 3/1991 | Touzani . | |
| 5,027,963 | 7/1991 | Robbins, III . | |
| 5,114,011 | 5/1992 | Robbins, III | 215/900 X |
| 5,219,628 | 6/1993 | Hathaway et al. . | |
| 5,226,551 | 7/1993 | Robbins, III . | |
| 5,266,763 | 11/1993 | Colombo . | |
| 5,300,748 | 4/1994 | Colombo . | |
| 5,348,173 | 9/1994 | Norwood | 220/666 X |
| 5,384,138 | 1/1995 | Robbins, III et al. | 220/666 X |
| 5,392,941 | 2/1995 | Robbins, III | 220/666 X |
| 5,632,406 | 5/1997 | Robbins, III | 220/666 |

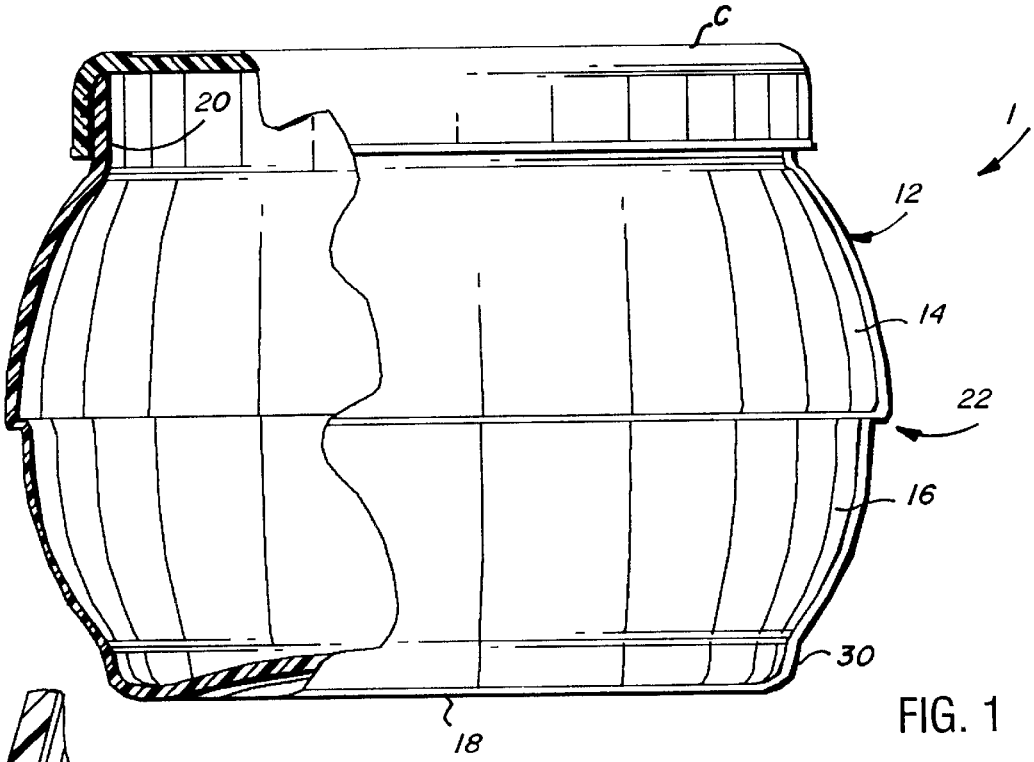
FIG. 1
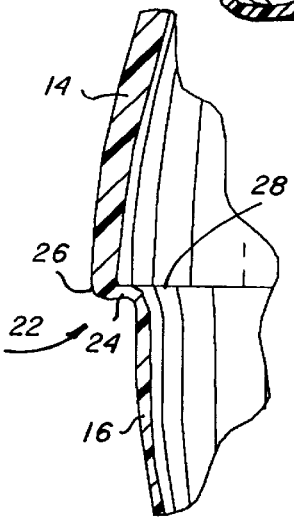
FIG. 3
FIG. 2
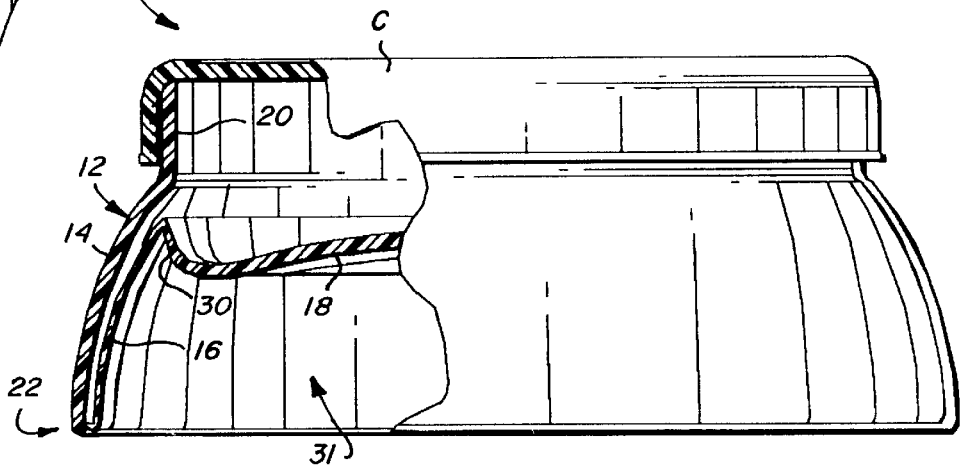

COLLAPSIBLE STORAGE CONTAINER

This is a continuation of application Ser. No. 08/630,509, filed 10 Apr. 1996, now abandoned.

TECHNICAL FIELD

This invention relates generally to collapsible plastic storage containers, and more specifically, to an improved peripheral side wall construction for such containers.

BACKGROUND PRIOR ART

Collapsible containers, drinking cups and the like are, of course, well known. For example, in applicant's own prior U.S. Pat. No. 4,930,644, a collapsible, thin film plastic container is disclosed wherein a major portion of the container side wall has a reduced wall thickness to permit random collapse of the side wall. In U.S. Pat. 4,865,211, a plastic bottle having a uniform wall thickness throughout the side wall, is configured to permit collapsing of the container through telescoping movement of one portion of the side wall into another portion of the side wall.

In U.S. Pat. 4,875,576, a container is disclosed wherein an intermediate portion of the side wall incorporates a bellows-type arrangement for facilitating collapse and extension of the container. The patent also discloses the use of helical creases which spiral or angle between first and second portions of the container side wall to facilitate collapsing action of the creased portion of the side wall.

In U.S. Pat. No. 4,873,100, a bi-stable, expandable plastic bottle is disclosed which incorporates bellows-type side wall for movement between collapsed and extended positions.

In U.S. Pat. No. 2,880,902, a collapsible drinking cup (or camera bellows) is disclosed wherein the side wall is composed of alternating thick and thin portions.

In U.S. Pat. Nos. 5,226,551 and 5,417,337, there are disclosed a variety of collapsible plastic containers incorporating peripheral side walls usually having at least three axial sections including an upper section, an intermediate section and a lower section. The intermediate section has a significantly reduced wall thickness permitting the lower section to be pushed upwardly into the upper section with the intermediate section reverse folded therebetween. In addition, the diameters of the intermediate section and at least part of the lower section are smaller than the upper section to facilitate the folding or collapsing process.

Of particular concern in collapsible container construction are the transition areas (or annular fold lines) between adjacent thick and thin sections of the peripheral side wall. This is because these areas often determine the ease or difficulty with which the collapsing/folding action is initiated. In addition, prior constructions have not been completely satisfactory in that cracking and fracture of the polymer can occur at the annular fold lines upon repeated collapsing and expansion movements. It will be appreciated that consumer acceptance depends on reliability, ease of use, cost, etc., and therefore, concerns about ease of use, reliability and durability must be addressed satisfactorily.

DISCLOSURE OF THE INVENTION

The principal object of this invention is to improve prior collapsible container constructions by providing an improved transition or fold area between adjacent thick and thin sections of the peripheral side wall of the container.

In one exemplary embodiment, a collapsible, plastic storage container made of single or multi layer thermoplastic polymer material(s) has a peripheral side wall formed with a relatively thin lower portion and a relatively thick upper portion, the two portions delimited by an annular fold line at approximately the axial mid point of the peripheral side wall. The container is also formed with relatively thick bottom and top end portions. The container is axially collapsible in that the lower portion of the peripheral side wall may be reverse folded upwardly into the upper side wall portion, with the bottom portion located proximate the top portion in the collapsed condition.

In another exemplary embodiment, a single fold collapsible plastic storage container, somewhat similar to that described above, is provided but wherein the upper portion of the peripheral side wall may be reverse folded downwardly into the lower side wall portion, with the upper discharge portion of the container located adjacent the container bottom wall in the collapsed condition.

It has now discovered that the foldability or collapsibility of the containers described above can be significantly enhanced by incorporating a specific transition geometry at the peripheral fold line between the upper and lower side wall portions which is substantially sideways S-shaped. In other words, in the transition area between the upper and lower portions of the side wall, the lowermost edge of the upper portion (defined by a first radius) and the uppermost edge of the lower portion (defined by a second radius) overlap in the axial direction such that when the two radiused areas are connected, a sideways S-shape results. While single fold containers are described herein, this axial overlapping arrangement can be utilized at any fold line location along the axial length of the container where folding or collapsing action is to occur. Moreover, the shape of the container is not limited to that which is illustrated and described herein.

Accordingly, in its broader aspects, the invention relates to a single fold collapsible container comprising a peripheral side wall extending upwardly from a bottom wall, and terminating at an upper open end; the side wall having upper and lower portions separated by a peripheral fold line having a sideways S-shaped geometry such that the upper and lower portions are movable relative to one another between extended and collapsed positions; and wherein one of the upper and lower portions has a wall thickness less than the other of the upper and lower portions.

The unique fold line of this invention minimizes failure of the material even after extended use and repeated movement of the side wall between extended and collapsed positions.

Other objects and advantages of the subject invention will become apparent from the detailed description which follows.

BRIEF DESCRIPTION OF THE DRAWINGS

FIG. 1 is a side elevation, partly in section, of a foldable container in accordance with a first embodiment of this invention;

FIG. 2 is a side elevation, partly in section, of the container of FIG. 1 in a folded or collapsed condition;

FIG. 3 is a partial, enlarged section of the container side wall, at the transition between upper and lower portions thereof;

BEST MODE FOR CARRYING OUT THE INVENTION

Figure 4:
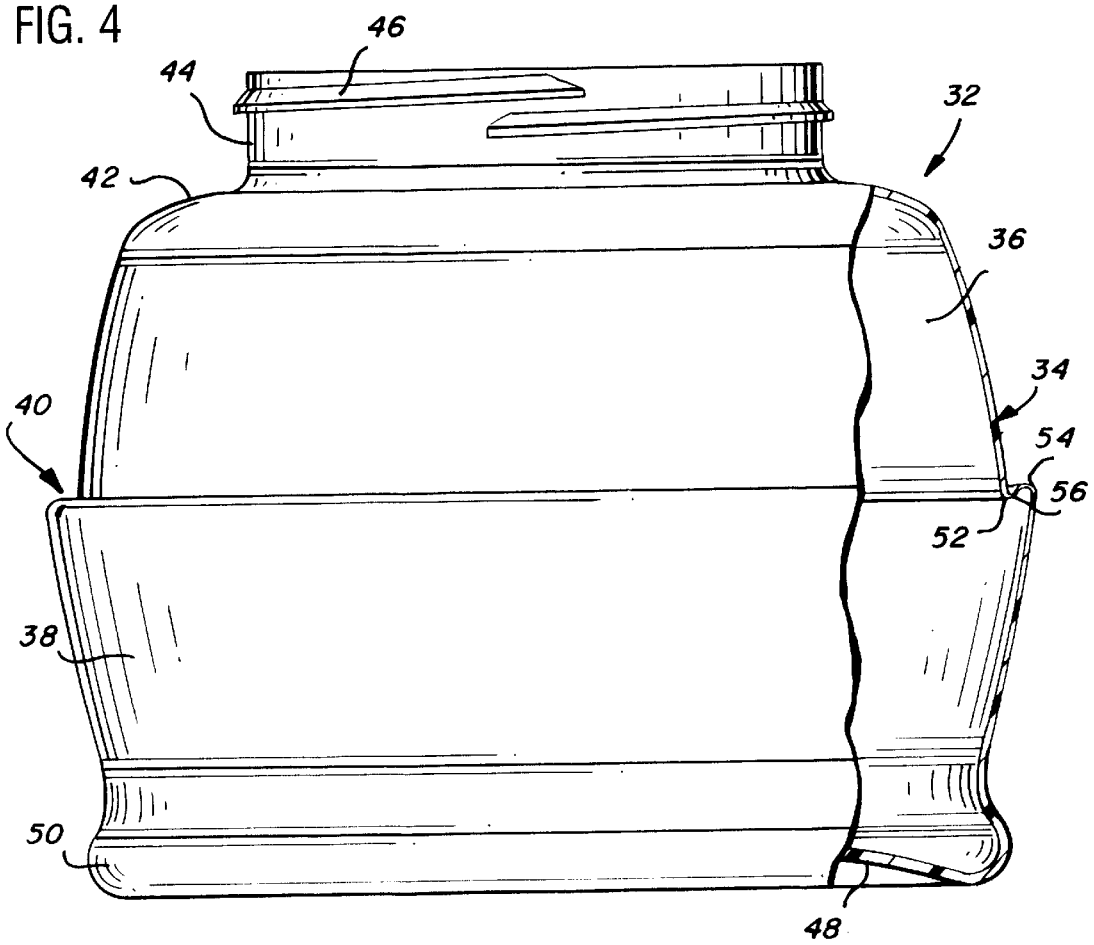
FIG. 4 is a side elevation, partly in section, of a foldable container in accordance with a second embodiment of the invention.

Referring now to FIG. 1, the container 10 is composed of a peripheral side wall 12 including a curved upper half portion 14 and a curved lower half portion 16; a bottom portion 18; and an open upper end portion defined in the exemplary embodiment by an upstanding rim 20. The latter may be provided with external threads (not shown) or other surfaces (of the "snap fit" type) for securing a closure C. The curvature of the side wall imparts a somewhat spherical shape to the container, with flattened top and bottom.

The upper side wall portion 14 meets the lower side wall portion 16 substantially at a peripheral fold line 22 defined by a radial flange 24 (see FIG. 3) extending outwardly and downwardly at about a 5° angle, relative to horizontal. The peripheral fold line is substantially at the horizontal center line of the container, but this location may vary somewhat. With radiused edges 26, 28 (each having a radius of about 0.025 inch) at either side of the flange 24, the merger between the upper and lower half portion assumes a sideways S-shape in cross section, best seen in FIG. 3. In addition, in this annular transition area or fold line, the wall thickness changes from a thickness of about 0.030 inch or more in the upper portion to a thickness of about 0.008 inch in the lower portion, i.e., less than half the thickness of the upper portion. Maximum diameter at the horizontal centerline is about 5.8 inches for a container height of about 5 inches.

The sideways S-curve configuration along fold line 22, in combination with the thin lower portion, allows the lower half to be pushed upwardly and reverse folded into the upper half of the container, to a collapsed position as shown in FIG. 2. In addition, the sideways S-curve configuration at the fold line 22 remains substantially intact during the folding action with the folding action occurring where the lower portion 16 merges with radiused edge 28.

The bottom 18 of the container is relatively rigid and may be of the same thickness as the upper half portion 14 of the side wall 12. The smaller diameter peripheral portion 30 of the bottom provides a good gripping surface for pushing and pulling the lower half 16 between the expanded position of FIG. 1 and the folded or collapsed position of FIG. 2.

It should also be noted that when the lower half portion 16 is folded upwardly, so as to lie substantially entirely within the upper half portion 14, a stacking recess 31 (FIG. 2) is provided, thus facilitating vertical stacking of a plurality of similar containers 10. It should be noted further that the lower wall portion 16 is sufficiently thin so that the curvature of the wall also reverses when the container is collapsed. Thus, the upper and lower portions are substantially parallel as best seen in FIG. 2.

Figure 5:
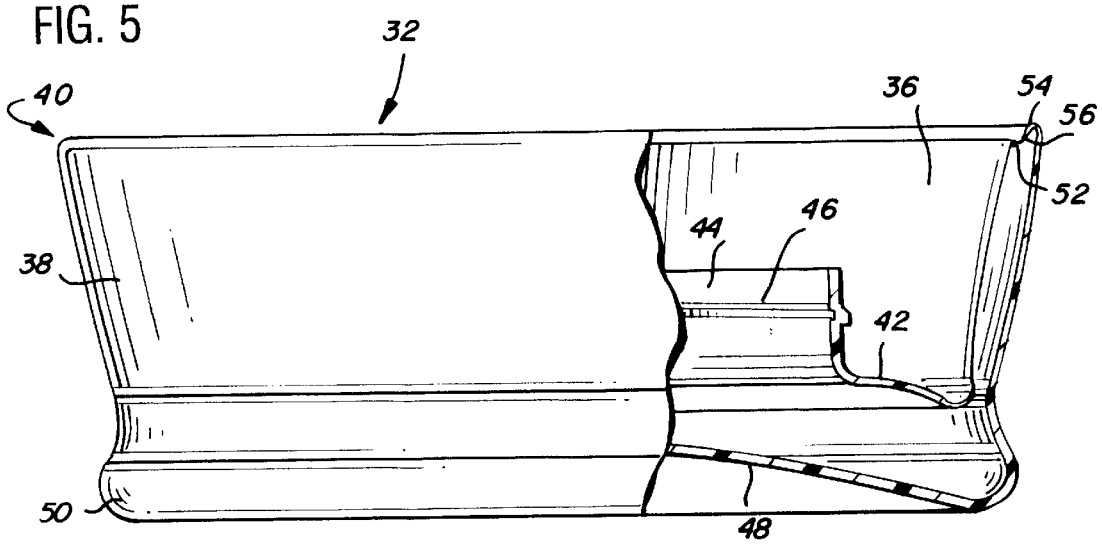
FIG. 5 is a side elevation, partly in section, of the container of FIG. 4 in a folded or collapsed condition.

Referring now to FIGS. 4 and 5, a container 32 in accordance with a second exemplary embodiment of the invention includes a peripheral side wall 34 which includes a gently curved upper half portion 36 which tapers outwardly in the downward direction, and a substantially frusto-conical lower half portion 38 which is tapered outwardly in an upward direction, with the upper and lower half portions of the container meeting at a peripheral fold line 40, described further hereinbelow. The upper side wall portion 36 merges with a shoulder 42 which, in turn, terminates at an upstanding discharge opening or rim 44. The rim 44 may be provided with closure securing means such as the thread 46 but it will be appreciated that other kinds of closures (for variously sized and shaped openings) may be utilized in connection with the container.

The lower side wall portion 38 joins to a container bottom wall 48 via an enlarged peripheral bead or flange 50 which provides a good gripping surface for moving the container between its extended and collapsed positions as also described below.

The peripheral fold line 40 is defined by a sideways shaped S geometry similar to that described above in connection with the first embodiment, with oppositely radiused edges 52, 54 defining generally a radial flange 56. The annular fold line 40, while generally similar to annular fold line 22 of the first described embodiment, nevertheless has a more pronounced sideways S-shaped geometry. Thus, the flange 56 generally extends outwardly and upwardly at an angle greater than the 5° angle of the earlier described flange but it will be appreciated that the specific dimensions may vary with, for example, container size, shape and the like.

In this second embodiment of the invention, the upper side wall portion 36 has a wall thickness less than the lower portion 38 which is relatively rigid and which may have a thickness substantially equal to the bottom wall 48 and the rim 44. Side wall thicknesses including thicknesses at the peripheral fold line 40 may be as described above in connection with the first embodiment. Movement to the collapsed position is achieved by pushing downwardly on the upper portion such that the upper side wall 46 undergoes a reverse folding action as it moves between the position shown in FIG. 4 to the collapsed position shown in FIG. 5. In the collapsed position, the upper open end of the container as defined by shoulder 42 and rim 44, lie substantially adjacent the bottom wall 40. It should also be noted that the sideways S-shaped geometry of the peripheral fold line 40 is essentially maintained when the container is in the collapsed position, with the reverse folding action occurring where the upper side wall portion 36 joins to the radiused portion 52 of the peripheral fold line.

Generally, the thickness dimensions and radii dimensions in the transition or fold areas may vary from those given as examples herein, depending on location of the fold, container geometry and size, etc. In addition, the transition or fold line areas can appear anywhere on the container where a folding feature is desired. In addition, the side wall fold line geometry described herein is applicable to container side walls having multiple layers (formed by coextrusion and blow molding for example) of plastic material, as well as to containers of different cross-sectional shape, i.e., round, oval, rounded square, etc.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A single fold collapsible container comprising:

a peripheral side wall extending upwardly from a bottom wall, and terminating at an upper open end; said side wall having upper and lower portions separated by a peripheral fold line having a sideways S-shaped geometry such that said upper and lower portions are movable relative to one another between extended and collapsed positions; and wherein one of said upper and lower portions has a wall thickness less than the other of said upper and lower portions; wherein said upper portion is thinner than said lower portion and collapsible into said lower portion by a reverse folding action, such that said upper open end is adjacent said bottom wall in said collapsed position; and wherein an uppermost edge of said lower portion extends above a lowermost edge of said upper portion when the container is in the extended position.

2. The container of claim 1 wherein said upper open end is defined by a shoulder and an upstanding rim.

3. The container of claim 1 wherein said peripheral side wall is round in horizontal cross-section, and wherein said upper and lower portions are tapered in opposite directions.

4. The collapsible container of claim 1 wherein an uppermost edge of said lower portion is connected to said lowermost edge of said upper portion by a flange inclined to horizontal by an angle of at least about 5°.

5. The container of claim 4 wherein said radial flange defines a transition area between said upper and lower portions, with thickness varying from about 0.03 inch to about 0.008 inch.

6. The collapsible container of claim 1 wherein, when folded, a nesting recess is formed in the container of a size sufficient to receive a part of another container of substantially identical construction.

7. The collapsible container of claim 1 wherein said bottom wall includes a gripper portion facilitating movement of the container side wall between extended and collapsed positions.

8. The foldable container of claim 1 wherein a maximum diameter of said container is about 5.8".

9. The foldable container of claim 8 wherein said container has a height of about 5 inches.

10. A single fold collapsible container comprising:

a peripheral side wall extending upwardly from a bottom wall and terminating at an upper open end; said side wall having upper and lower portions separated by a peripheral fold line having a sideways S-shaped geometry such that said upper and lower portions are movable relative to one another between extended and collapsed positions; and wherein one of said upper and lower portions has a wall thickness less than the other of said upper and lower portions; wherein said lower portion is thinner than said upper portion and collapsible into said upper position by a reverse folding action, such that said bottom wall is adjacent said upper open end in said collapsed position; and wherein a lowermost edge of said upper portion extends below an uppermost edge of said lower portion when the container is in the extended position.

11. The container of claim 10 wherein said peripheral side wall is round, in horizontal cross-section and wherein said upper portion of said side wall is curved in vertical cross section, extending from one diameter adjacent said upper open end to a larger second diameter at said fold line.

12. The container of claim 11 wherein said lower portion of said side wall is curved in vertical cross section, extending from a third diameter adjacent said bottom wall to a fourth, larger diameter at said fold line, wherein said fourth diameter is smaller than said second diameter.

13. The collapsible container of claim 10 wherein said uppermost edge of said lower portion is connected to said lowermost edge of said upper portion by a radial flange inclined to horizontal by an angle of at least about 5°.

14. The collapsible container of claim 10 wherein said bottom wall includes a gripper portion facilitating movement of the container side wall between extended and collapsed positions.

15. The container of claim 13 wherein said radial flange defines a transition area between said upper and lower portions, with thickness varying from about 0.03 inch to about 0.008 inch.

* * * * *